United States Patent [19]

Weisser et al.

[11] 4,289,300

[45] Sep. 15, 1981

[54] CAR JACK

[75] Inventors: Dieter Weisser, Tuttlingen; Franz Hafner, Wurmlingen, both of Fed. Rep. of Germany

[73] Assignee: E.A. Storz GmbH & Co., KG, Tuttlingen, Fed. Rep. of Germany

[21] Appl. No.: 97,911

[22] Filed: Nov. 28, 1979

[30] Foreign Application Priority Data

Dec. 1, 1978 [DE] Fed. Rep. of Germany ..... 2851980

[51] Int. Cl.[3] ..... B66F 3/12

[52] U.S. Cl. ..... 254/126

[58] Field of Search ..... 254/126, 108–111

[56] References Cited

U.S. PATENT DOCUMENTS 1,475,864 11/1923 Perry et al. ..... 254/126 X
2,487,553 11/1949 Hunz ..... 254/110
3,163,925 1/1965 Ulm ..... 254/111 X
3,317,187 5/1967 Steppon ..... 254/126
3,989,225 11/1976 Keilholz ..... 254/126

*Primary Examiner*—Robert C. Watson
*Attorney, Agent, or Firm*—Spencer & Kaye

[57] ABSTRACT

There is provided a car jack comprising a column attached at its bottom to a base, and a load-carrying arm pivoted to the column and movable by a screw spindle. The screw spindle is pivotably supported by a nut at the top of the column and by an abutment of the load-carrying arm. The arm and the column are formed from metal sections of U-shaped cross-section with the edges of the side limbs outwardly bent. Each of the outwardly bent parts is formed as a bead extending along the entire length of the side limb with its edge disposed in the plane of the internal flat side of the respective limb.

10 Claims, 6 Drawing Figures

CAR JACK

The invention relates to a car jack, for instance of the type comprising a column with a bottom end fixed to a base and a load carrying arm pivotably attached to the column and pivotable by means of a screw spindle which is operable by means of a hand crank and is pivotably supported by a screw spindle nut at the top end of the column and the screw spindle abutment on the load carrying arm, the load-carrying arm and the column being formed by metal sections of U-shaped cross-section and the edge parts of the side portions thereof being outwardly bent from the base, at least over part of their length, to increase their distance from the plane of symmetry of the section.

Car jacks of this type are known. The longitudinal extent of the portions of the column formed by a metal section of U-shaped cross-section is itself sectioned so that the column is able to be constructed with wall thicknesses which result in a hitherto acceptable deadweight of the car jack and adequate torsion resistance when supporting a load.

Proceeding from the base to a position near the top end of the column the edge parts of the column side portions are bent or offset approximately at right angles from the plane of symmetry of the section in order to obtain such sectioning and in the first case the width of the members is correspondingly reduced and in the latter case the distance of one part of the member from the plane of symmetry of the section is correspondingly increased.

Such sectioning meets the demands of the desired column stiffening effect to ensure an adequate moment of resistance but suffers from the disadvantage that when the load-carrying arm, supported between the side portions of the column, is pivoted upwardly, it is not laterally supported over the whole width of the side portions but only over a relatively short region of its length, as seen from its pivoting shaft. This means that, given the relatively long length of the load-carrying arm part which is not laterally supported, the latter can be deformed or drift to a certain extent in the lateral direction under the action of a supported load.

The resulting lever forces must be absorbed by the portions of the column, the cross-section of which must therefore be dimensioned to the corresponding thickness.

According to one aspect of the invention, there is provided a car jack comprising a column the bottom end of which is attached to a base, and a load-carrying arm which is supported on a cross-pivoting shaft attached to the column and is pivotable by means of a screw spindle which is operable by means of a hand crank and is pivotably supported by a screw spindle nut at the top end of the column and by a screw spindle abutment on the load-carrying arm, the load-carrying arm and the column being formed by metal sections of U-shaped cross-section and, to increase the torsional resistance of the column, the edge parts of the side portions thereof being outwardly bent from the base, at least over part of their length, to increase their distance from the plane of symmetry of the section, each of the outwardly bent parts of the column portions having the shape of a bead extending along the entire length of the column portions and the exposed edge parts of the beads being disposed substantially in the plane of the internal flat sides of the respective column portions supporting the beads.

According to another aspect of the invention there is provided a car jack comprising a column the bottom end of which is attached to a base, and a load-carrying arm which is supported on a cross-pivoting shaft attached to the column and is pivotable by means of a screw spindle which is operable by means of a hand crank and is pivotably supported by a screw spindle nut at the top end of the column and by a screw spindle abutment on the load-carrying arm, the load-carrying arm and the column being formed by metal sections of U-shaped cross-section, the column being extruded and the inside of the side portions of the column being flat as far as the edge portions thereof, the cross-section of the edge portions being thickened.

It is thus possible to provide a more stable arrangement of the load carrying arm and improved lateral support on the column, and to achieve a weight reduction of the car jack by a possible reduction of the wall thickness of the column.

The edge portions of the column side portions of such a car jack are therefore deformed to increase the torsion resistance and are shaped into a bead, whose free edge part is disposed in the plane of the inner flat side associated with the column portions which support the bead.

There may be achieved a substantially greater stiffening of the column members and an important advantage that the load carrying arm end piece, which is hinged to the column, is laterally supported over a longer length and the beads, which provide the increased supporting range, are able to offer to the load-carrying arm a moment of resistance which is several times greater than that of the underformed member region.

The wall thickness of the column section can thus be reduced by providing the column side portions with beads. It is possible to produce columns of such car jacks of light alloy and in this case the load-carrying arms may also be constructed of light alloy.

Tests have shown that such car jacks constructed of light alloy can be made lighter by up to 50% while providing the same load-carrying capacity. Such car jacks can advantageously meet the demands recently made in automotive construction for a substantial weight reduction.

The beads of the column portions can have a semicircular cross-section or can be substantially of semioval construction and a web provided in the plane of the portion which supports the bead and extends over the entire length thereof can be integrally formed on the free edge piece of said bead.

The torsion resistance of the column can be further increased by virtue of lateral web parts, which support the side portions of the column and are associated with the web which interconnects the said portions, being shaped in the form of a bead.

The column may be constructed of light alloy, more particularly aluminium and to this end it is advantageous to employ an extruded section the inside of whose members is formed flat as far as the longitudinal edge part on which part they are thickened over the cross-section. These fitted portions of the cross-section can either form relatively thick webs which project laterally from the members and one of whose web walls is disposed substantially in the plane of the external surface of the connecting web or the said fitting portions of the cross-sectional can form longitudinal beads which extend from the outside of the member to the rear of the connecting web.

The invention will be further described, by way of example, with reference to the accompanying drawings, in which.

Figure 3:
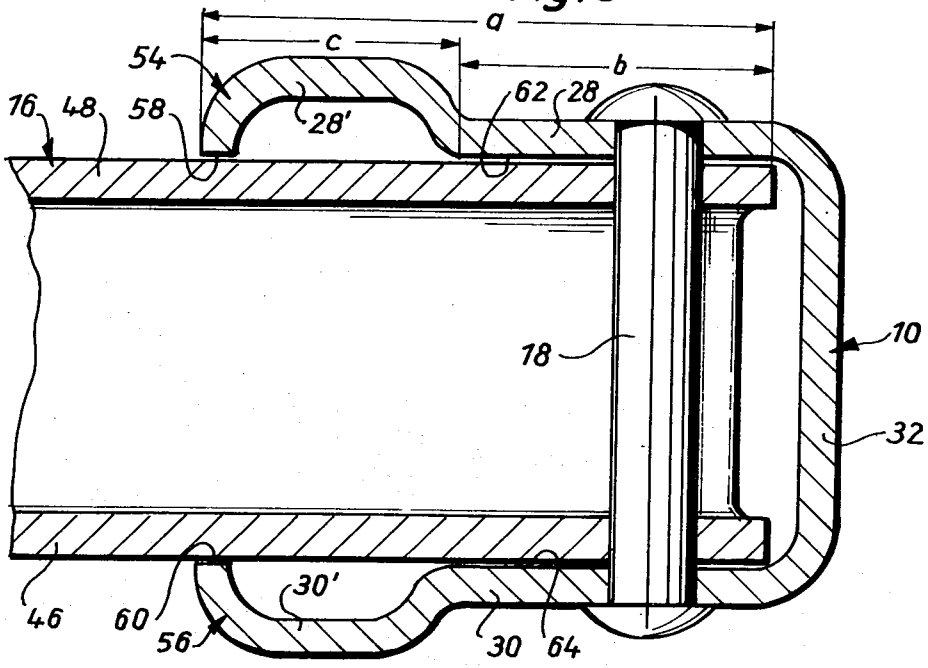
FIG. 3 is a cross-section through the car jack along the line 3—3 of FIG. 1 shown to a larger scale than that of FIG. 1.

The illustrated jointed jack has a column 10 of U-shaped cross-section as shown in FIG. 3 and supporting at its bottom end a base 12 which is constructed in known manner by a bent support plate the underside of which is provided with projections in the form of support claws 14. One end of a load-carrying arm 16 is supported approximately in the middle part of the column so as to be pivotable about a cross-pivoting shaft 18 and a load support 20, hereinafter referred to as a horn, is provided at the free end of the arm to enable the load-carrying arm 16 to bear on the body underside of a vehicle which is to be raised. The said horn 20, for example formed as a solid plastics moulding, has an indentation such as 22 which extends perpendicularly to the plane of the moulding and is provided in the middle of the horn 20 to accomodate a bodywork web formed by a flanged seam. The said indentation 22, which extends transversely through the horn 20 thus forms two load supporting humps 24, 26 which successively support the load of the vehicle in the course of the pivoting motion of the load carrying arm 16. The horn 20 can however also have any other suitable construction.

Figure 1:
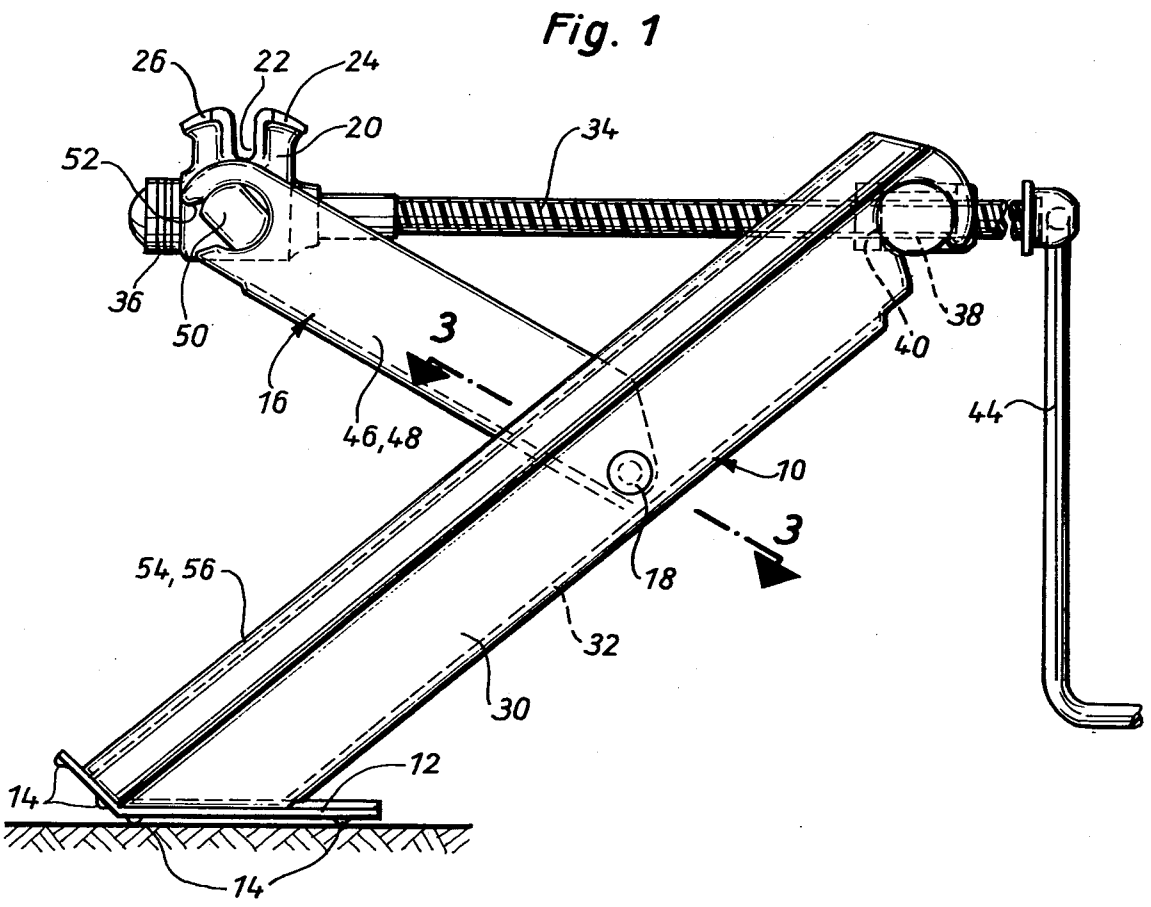
FIG. 1 is a side view of a jointed jack with a column in which a load carrying arm is pivoted into its middle lifting position.
Figure 2:
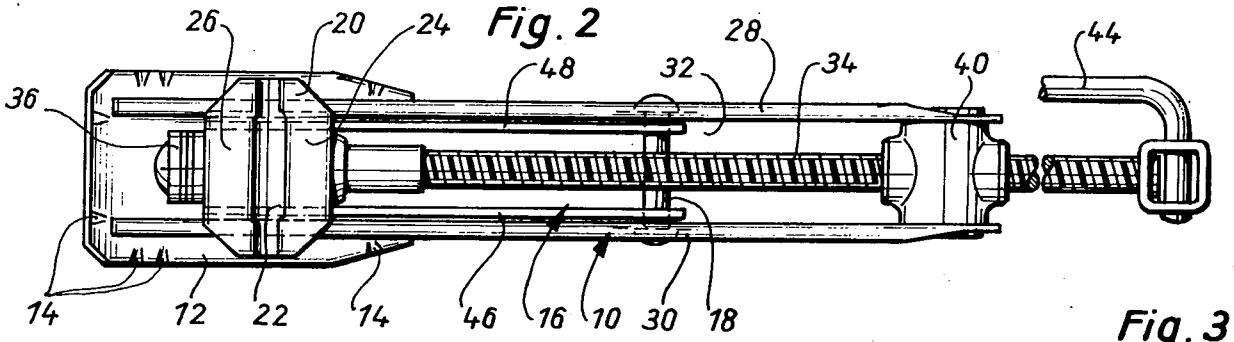
FIG. 2 is a plan view of the car jack of FIG. 1.

As shown in FIGS. 2 and 3, the cross-pivoting shaft 18 is disposed in the column portions 28 and 30 spaced by and connected to a web portion 32 of the column.

The load carrying arm 16 can be pivoted about the cross-pivoting shaft 18 by means of a screwthreaded spindle 34, one end member of which extends through the horn 20 and is rotatable therein but is supported so as to be axially unslidable, and the screwthreaded spindle 34 bears upon a thrust bearing 36 when the load carrying arm 16 is pivoted in the upward direction.

The axial motion of the screwthreaded spindle 34 required for pivoting the load carrying arm 16 is obtained by a screwthreaded nut 38 which is disposed in a bearing bush 40 situated at the top end of the column 10. The number 44 refers to a hand crank, which is non-rotationally disposed at an end of the screwthreaded spindle 34 forming a swash plank for rotating the screwthreaded spindle 34.

The cross-section of the load carrying arm 16 is also U-shaped and the two side portions 46, 48 thereof are disposed at a distance from each other which is such that the load-carrying arm can be supported on the cross-pivoting shaft 18 with slight lateral clearance between the portions 28, 30 of the column. The major part of the length of the support arm is disposed between the portions 28, 30 of the column when the said arm is in its botom starting position.

The horn 20 is pivotably supported between the side portions 46, 48 of the load-carrying arm by two lateral bearing trunnions 50, each of which is pivotably supported in a slot 52 similarly to the bearing bush 40 of the screwthreaded nut 38. The screwthreaded spindle 34, extending through the horn 20, forms a positive guide which ensures that, when the load-carrying arm 16 is pivoted in the upward direction, the horn 20 is retained relative to the vehicle bodywork in a position in which the flanged seam of the bodywork is always disposed approximately in the middle of the indentation 22 and substantially remains in such position.

As shown in FIG. 3, each of the edge portions 28' or 30' of the column members 28, 30 forms a bead 54 or 56 which advantageously extends over the entire length of the column portions from the base. The edge portions 28', 30' are shaped so that the free edge parts 58 and 60 thereof are disposed substantially in the plane of the inner flat side 62 or 64 of the portions 28, 30. Accordingly when the support arm 16 is in its outward pivoted position the portions 46, 48 of said arm are laterally effectively supported within the column along a region a whereas in known car jack designs of this kind the said portions were laterally supported merely over the region b.

The beads 54, 56, fixedly connected to the base 12 thus form substantial stiffening for the column portions and moreover provide an extension for the load carrying arm guide, resulting in an increase of torsion resistance of the column so that the wall thickness thereof can be substantially reduced in comparison with known car jacks of a similar kind. The cross-section of the beads 54, 56 in the embodiment shown in FIG. 3 are substantially of semioval construction and the width c of the beads is advantageously in the ratio of approximately 1:3 with the overall length of the column portions and the bead depth is approximately in the ratio of approximately 1:1 with the wall thickness of the column portions.

Figure 4:
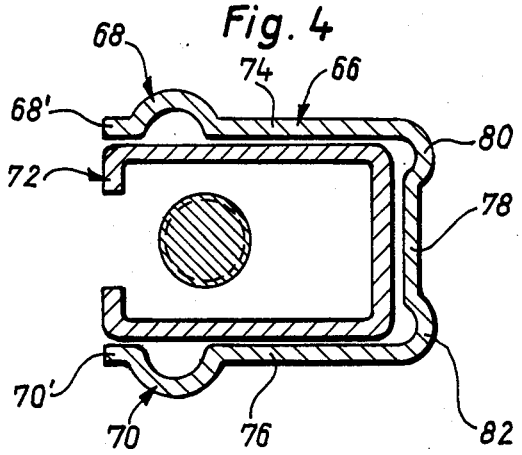
FIG. 4 is a cross-section through another type of column in which the load carrying arm of the jointed jack is disposed in its starting position within the column.

The column shown in FIG. 4 differs from the previously described column construction in that the cross-section of the beads 68, 70 of the column 66 is substantially of semicircular construction and a web 68' or 70' extending over the entire length of the beads is integrally formed on the free edge part of the beads, the web being disposed in the plane of the remaining parts of the members. This also achieves stable lateral guiding for the load-carrying arm 72. Furthermore, the regions in which the column portions 74, 76 merge with the web 78, which interconnects these portions, are constructed in the manner of beads 80, 82, thus providing additional stiffening of the column.

Figure 5:
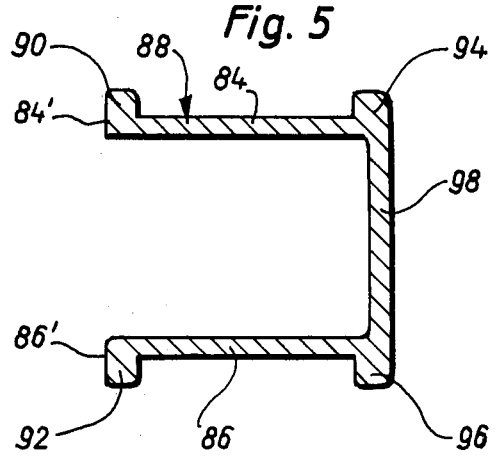
FIGS. 5 and 6 are cross-sections through further car jack columns which are made of extruded light alloy sections.
Figure 6:
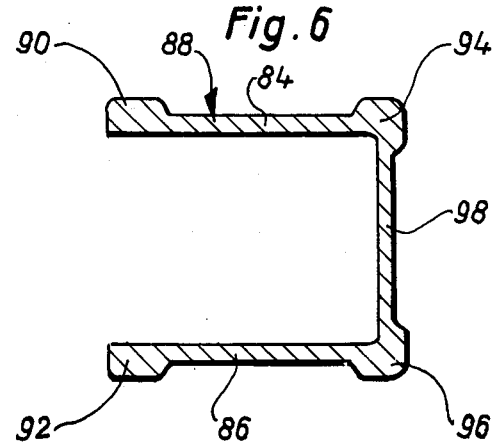

FIGS. 5 and 6 show preferred cross-sectional shapes of columns which are extruded in light alloy.

The insides of the portions 84, 86 of the column 88 shown in FIG. 5 are constructed in flat configuration as far as their outer edge parts 84', 86' and a continuous longitudinal web 90 or 92 is integrally formed in the region of each of the edge parts on each outside of the portions. Thickened portions of the cross-section, which do not project beyond the rear of the connecting web 98 but form longitudinal webs 94, 96 are integrally formed in like manner in the region of the rear longitudinal edge of the portions.

The construction shown in FIG. 6 differs from that of FIG. 5 merely in the construction of the longitudinal webs which in this case form external beads and the rear longitudinal webs 94, 96 extend from the outside of the members 84, 86 to the rear of the connecting web 98.

The beads which are integrally formed on the column members as well as the members themselves are fixedly joined to the base, for example by welding.

We claim:

1. A car jack comprising a column having a top end and a bottom end, a load-carrying arm, a cross-pivoting shaft, a screw spindle, a base, a crank handle, a screw spindle nut, and a screw spindle abutment, said column being formed of metal section of U-shaped cross-section, said metal section of said column having side walls with internal flat side portions and edge parts outwardly bent and shaped as beads with edges, wherein said bottom end of said column is attached to said base, said load-carrying arm is supported on said cross-pivoting shaft which is attached to said column and is pivotable by said screw spindle operable by said crank handle, said screw spindle is pivotably supported by said screw spindle nut and by said screw spindle abutment at said column and on said load-carrying arm, said beads extend at least over part of the length of said column side walls, and said bead edges are disposed substantially in the plane of said internal flat side portions of said respective side walls.

2. A car jack as set forth in claim 1, wherein the cross-sectional shape of said beads is substantially semi-oval.

3. A car jack as set forth in claim 1, wherein the cross-sectional shape of said beads is semicircular.

4. A car jack as set forth in claim 3, wherein a web, which extends over the entire length of each of said beads and is provided in the plane of said respective side portions supporting each said bead, is integrally formed at said edge of each said bead.

5. A car jack as set forth in claim 1, wherein lateral bead portions support said side portions and are associated with the web which interconnects said side portions.

6. A car jack comprising a column having a top end and a bottom end, a base, a load carrying arm, a cross pivoting shaft, a screw handle, a hand crank, a screw spindle nut, and a screw spindle abutment, said column being formed of metal section of U-shaped cross-section, wherein said bottom end of said column is attached to said base, said load carrying arm is supported on said cross-pivoting shaft which is attached to said column and is pivotable by said screw spindle operable by said hand crank said screw spindle is pivotably supported by said screw spindle nut and by said screw spindle abutment at said column and on said load carrying arm, said column is extruded and has side walls with insides which are flat as far as edge portions thereof, and the cross-section of said edge portions of the walls is thickened.

7. A car jack as set forth in claim 6, wherein said column has an outside which is constructed with a thickened cross-section in the region along longitudinal edges formed by said side walls and by the web which interconnects said side walls.

8. A car jack as set forth in claim 7, wherein said thickened portions of said cross-sections form relatively thick webs which project laterally from said side portions of the walls.

9. A car jack as set forth in claim 7, wherein said thickened portions of said cross-sections form longitudinal beads which extend from said outside of said side walls to the rear of said web.

10. A car jack as set forth in claim 1 wherein said side walls of the column extend over the entire length thereof.

* * * * *